US005361866A

United States Patent [19]

Bell et al.

[11] Patent Number: 5,361,866

[45] Date of Patent: Nov. 8, 1994

[54] CONNECTOR ASSEMBLY FOR USE ON SCAFFOLDING TO PREVENT A WORKER FROM FALLING

[75] Inventors: Michael Bell, 1704 Triumphe Way, Warrington, Pa. 18976; Richard Mickelson, Barling, Ark.

[73] Assignee: Michael Bell, Warrington, Pa.

[21] Appl. No.: 129,536

[22] Filed: Sep. 30, 1993

[51] Int. Cl.[5] ..... A62B 35/00

[52] U.S. Cl. ..... 182/3; 182/36

[58] Field of Search ..... 182/3–9, 182/36, 129

[56] References Cited

U.S. PATENT DOCUMENTS

| | | | |
|---|---|---|---|
| 3,737,893 | 9/1973 | Hobbs | 182/6 |
| 4,607,724 | 8/1986 | Hillberg | 182/36 X |
| 4,721,182 | 1/1988 | Brinkmann et al. | 182/36 X |
| 5,219,039 | 6/1993 | Bell | 182/3 |

*Primary Examiner*—Alvin C. Chin-Shue

*Attorney, Agent, or Firm*—Caesar, Rivise, Bernstein, Cohen & Pokotilow, Ltd.

[57] ABSTRACT

A connector assembly for releasable securement to a portion of scaffolding on which a worker wearing a safety restraint member, e.g., safety belt and associated lanyard, will be disposed. The portion of the scaffolding comprises a cylindrical section having a pair of collars disposed on it. Each of the collars defines a channel between it and the cylindrical section. The connector assembly comprises an insert, a first connector pivotally secured by a bolt to the insert, a strap formed of a flexible web of material and having a loop at one end secured to the first connector, and D-ring secured to a loop at the other end of the strap. The insert has a pair of projections, each of which is arranged to be located within a respective one of the channels between the collars and the cylindrical section of the scaffolding to releasably secure the insert in place with respect to the scaffolding. The D-ring serves as a convenient connector for securing the lanyard thereto. A reinforcing pad formed of a wear resistant material is secured to the strap.

10 Claims, 3 Drawing Sheets

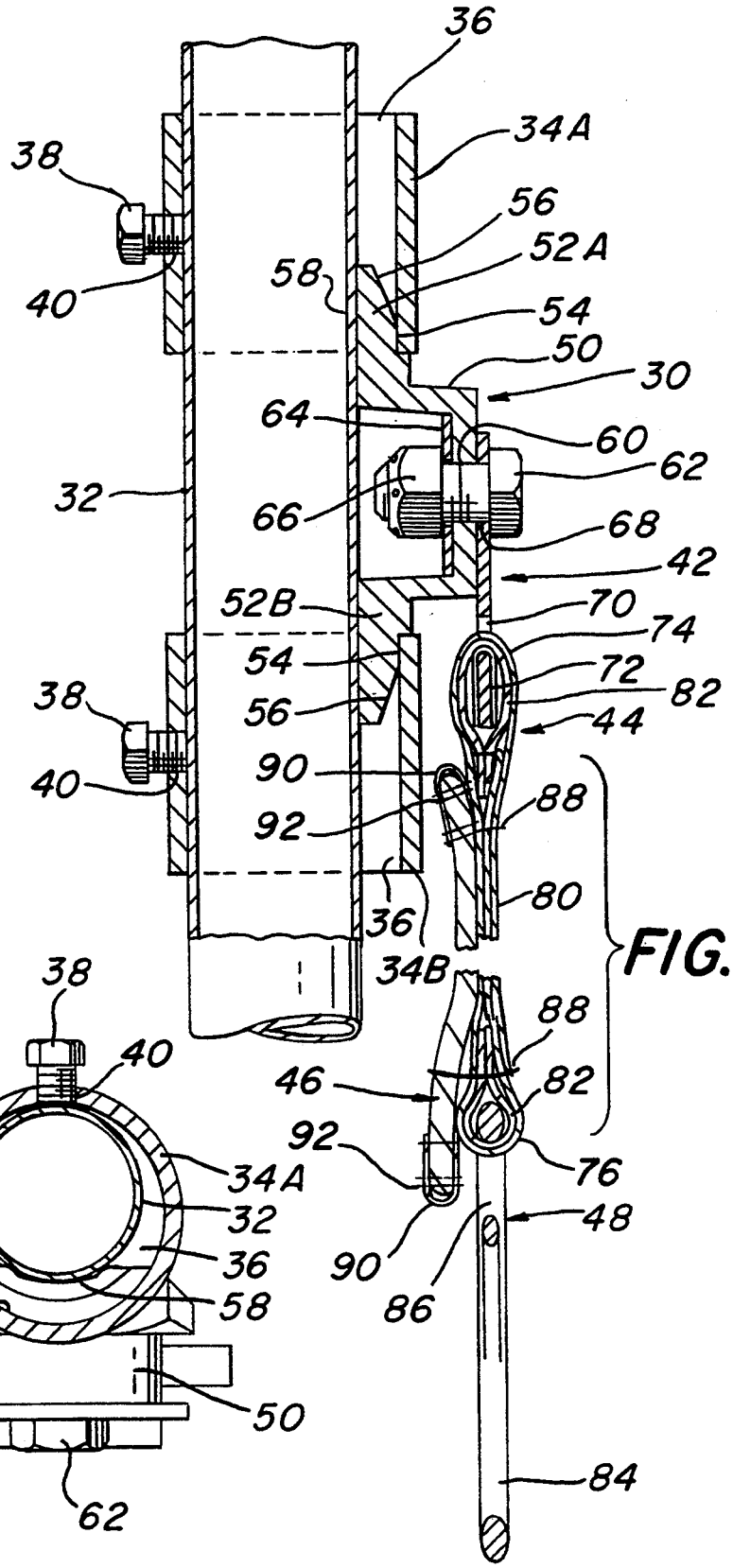
FIG. 3
FIG. 4
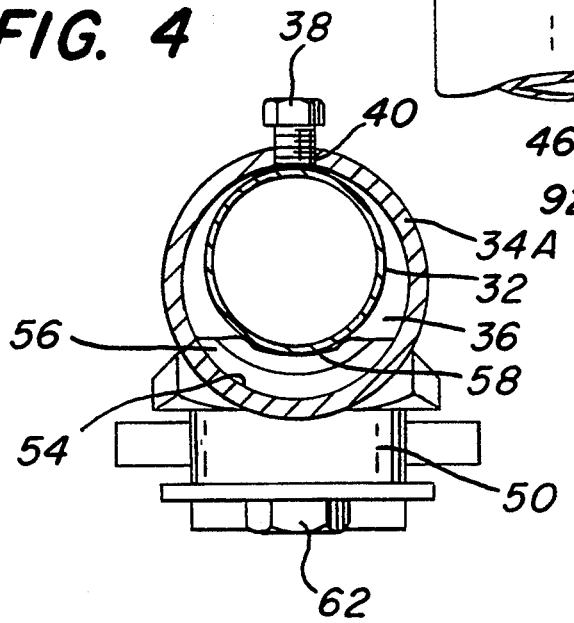

CONNECTOR ASSEMBLY FOR USE ON SCAFFOLDING TO PREVENT A WORKER FROM FALLING

BACKGROUND OF THE INVENTION

This invention relates generally to safety devices and more particularly, to a connector assembly for use on scaffolding to be secured to a worker to prevent the worker from falling.

Due to the enactment of various safety laws, persons working at elevated positions, e.g., on scaffolding, etc., are required to be protected against falls. One common approach to achieve that end is the use of a safety belt which is worn on the worker's waist. The belt includes a D-ring or some other metal loop fixedly mounted on the belt in the center of the portion located at the worker's back. The D-ring is arranged to be "tied off" (connected), via a lanyard, to a fixed supporting member or anchor point. The anchor point may be any fixed portion of the scaffolding which is strong enough to support the worker's weight. The securement of the lanyard to the anchor point is typically accomplished by wrapping the lanyard at least once about a horizontally extending portion of the scaffolding. Thus, once the worker is tied off should he/she fall off of the structure he/she will be prevented from falling to the ground. While this technique of preventing falls is generally suitable for its intended purposes it never the less suffers from some drawbacks. For example, by wrapping the lanyard at least once about the anchor point the already relatively short standard lanyard (e.g., typically six feet in length) is substantially reduced, thereby severely restricting the worker's mobility. Moreover, if the lanyard is wrapped about a vertical portion of the scaffolding and is not held at the point at which it is wrapped about the member, it will likely slide down the member to the lowest point that it can. In so doing the worker may be exposed to a drop in excess of six feet, thereby violating OSHA regulations, before the lanyard becomes taut to preclude further droppage.

The prior art has not addressed the foregoing factors in an adequate manner heretofore.

OBJECTS OF THE INVENTION

Accordingly, it is a general object of this invention to provide a connector assembly for securement to scaffolding or some other elevated structure which overcomes the disadvantages of the prior art.

It is another object of this invention to provide a connector assembly for releasable securement to scaffolding which is effective to prevent a worker connected thereto from falling.

It still another object of this invention to provide a connector assembly for releasable securement to scaffolding which is easy to use.

It is yet another object of this invention to provide a connector assembly for releasable securement to scaffolding which is simple in construction.

SUMMARY OF THE INVENTION

These and other objects of this invention are achieved by providing a connector assembly for releasable securement to a portion of scaffolding on which a worker wearing a safety restraint member will be disposed. The portion of the scaffolding comprises a cylindrical section having a pair of collars disposed on it.

Each of the collars defines a channel between it and the cylindrical section.

The connector assembly comprises insert means, a first connector member, strap means, reinforcing means, and a second connector member. The insert means has a pair of projections, each of which is arranged to be located within a respective one of the channels between the collars and the cylindrical section of the scaffolding to releasably secure the insert means in place with respect to the scaffolding.

The first connector member has a slot therein. The second connector member has a slot therein and a hole for releasably securing the safety restraint thereto. The strap means comprises an elongated flexible member having a top and bottom surface and pair of ends, each end being in the form of a loop. The first connector member is pivotally connected to the insert means.

One of the loops of the strap means extends through the slot in the first connector, and the other one of the loops of the strap means extends through the slot in the second connector, thereby fixedly securing the first and second connectors to the ends of the strap means.

The reinforcing means comprises a pad of a wear resistant material secured to one of the top or bottom surfaces of the strap means.

DESCRIPTION OF THE DRAWINGS

Other objects and many attendant features of this invention will become readily appreciated as the same becomes better understood by reference to the following detailed description when considered in connection with the accompanying drawings wherein:

FIG. 3 is a sectional view taken along line 3—3 of FIG. 2; and

FIG. 4 is a sectional view taken along line 4—4 of FIG. 1.

DETAILED DESCRIPTION OF THE PREFERRED EMBODIMENTS

Figure 1:
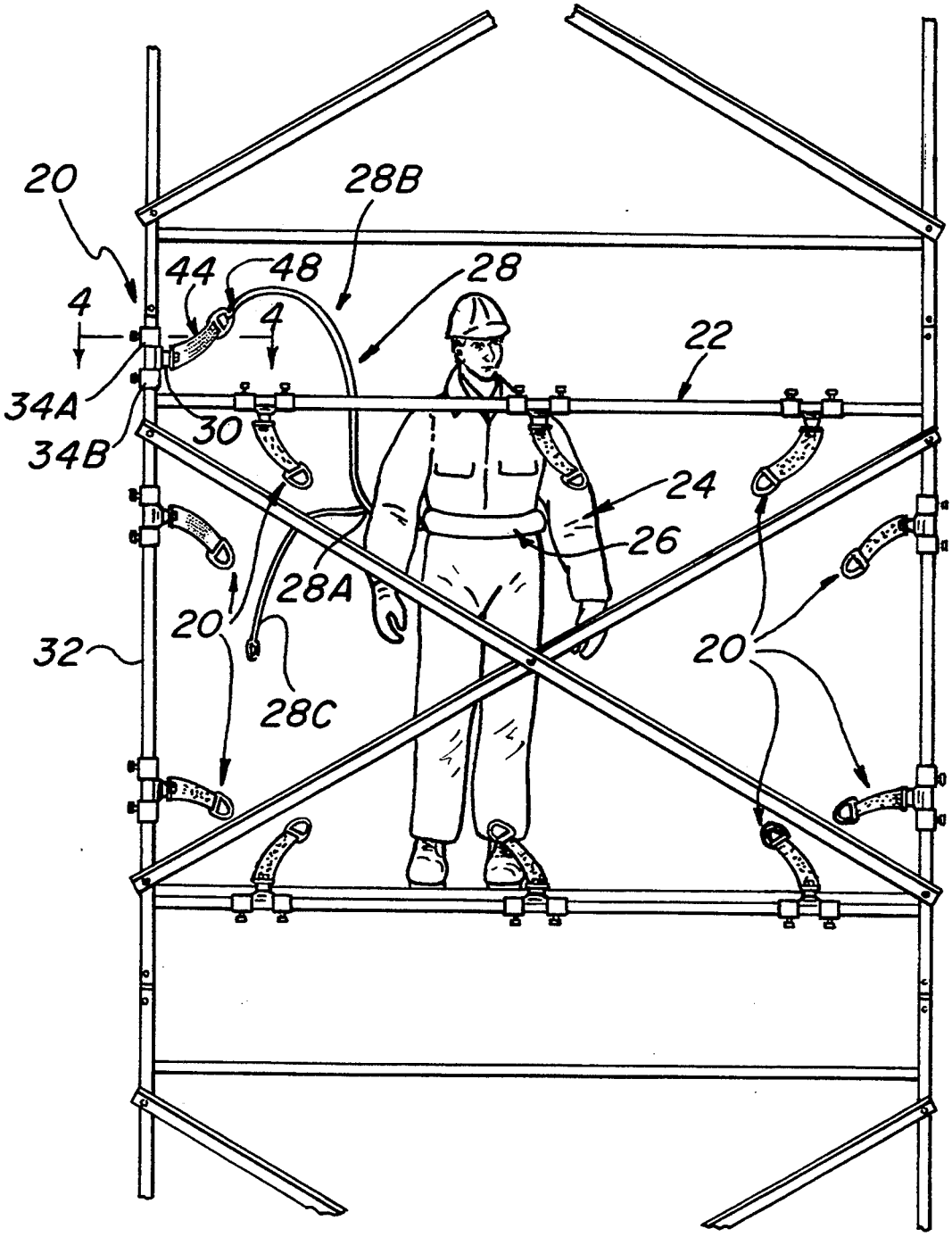
FIG. 1 is a front elevational view of scaffolding with a worker thereon and plural connector assemblies constructed in accordance with this invention, with the worker shown being connected by one of the connectors to a fixed anchor point on the scaffolding for protecting the worker from falling off of the scaffolding.

Referring now to various figures of the drawing where like reference numerals refer to like parts there is shown at 20 in FIG. 1, a connector assembly constructed in accordance with this invention and arranged for releasable securement to conventional scaffolding 22 so that a worker 24 wearing a conventional safety belt 26 or a harness (not shown) having a conventional lanyard 28 secured thereto can be secured to the connector, thus protecting the worker from a fall. In accordance with a preferred use of this invention, plural connectors 20 are secured to the scaffolding at predetermined spaced locations, e.g., at 19 inch (48 cm) centers, on the structural components making up the scaffolding so that a worker can be readily secured thereto irrespect of where the worker is located on the scaffolding. Thus, as can be seen in FIG. 1 plural connectors 20 are secured to the horizontal rails 22A and the vertical posts 22B making up the scaffolding 22.

The connector assembly 20 of this invention will be described in detail later. Suffice it for now to state that it includes a connector blade or insert 30 of conventional construction for securement to either the tubular post 22B or the tubular rail 22A of the scaffolding 22 by means of a pair of collars or rings 34A and 34B mounted on the post or rail. Thus, for each connector assembly 20 mounted on the scaffolding a pair of collars 34A and 34B are provided. In accordance with a preferred embodiment of this invention the collars 34A and 34B and the blade or insert 30 are sold by Cherokee Construction, Inc. of Baton Rouge, La.

Figure 2:
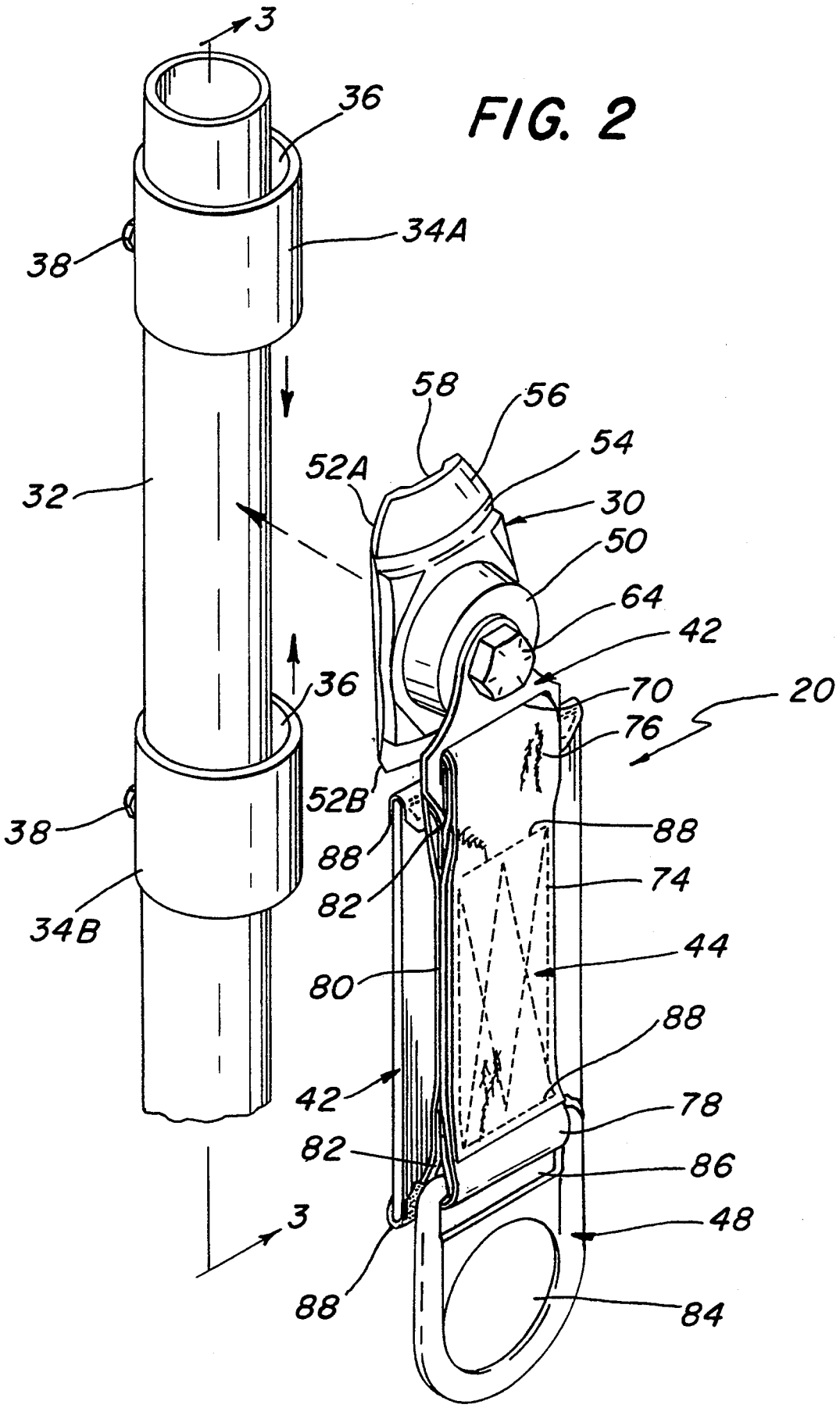
FIG. 2 is an enlarged isometric view of the connector assembly shown in FIG. 1 shown being releasably secured to a portion of scaffolding.

As can be seen in FIGS. 2 and 3 the collars 34A and 34B are of identical construction, i.e., a tubular member, formed of any suitable high-strength material, e.g., steel. The inside diameter of each of the collars is substantially greater than the outside diameter of the tubular post 32. The collars are disposed slightly spaced apart on the scaffolding post to receive the insert therebetween. In particular, the collar 34A is disposed on the post 30, with a portion of the interior surface of the collar abutting a portion of the exterior surface of the post, thereby producing a channel or slot 36 between the collar and the post on the opposite side from the point at which the collar and post abut. It is in this slot 36 that one portion of the insert 30 (to be described later) is located to releasably secure the insert to the post. The collar 34B is similarly disposed on the post, slightly below the collar 34A, to receive another portion of the insert 30 to complete the securement of the insert to the post. A set screw 38 extends through an threaded opening 40 in each of the collar 34A and 34B to engage the abutting portion of the post to lock the collars and insert 30 in place, as will be described later.

Referring now to FIGS. 2 and 3 the details of the connector assembly 20 will now be considered. As can be seen therein that assembly basically comprises the heretofore identified insert 30, a first connector member 42, a strap 44, a reinforcing pad 46, and a second connector member 48. The insert 30 is a blade-like member formed as an integral unit of any suitable material, e.g., cast metal, and basically comprises a central body portion 50 from which a pair of tabs or ears 52A and 52B project. As will be described in detail later the ear 52A of the insert 30 is arranged to be received within the slot 36 between the collar 34A and the post 32, while the ear 52B is arranged to be received within the slot 36 between the collar 34B and the post 32 to releasably secure the insert in place. Each of the ears includes a cylindrical outer surface portion 54 which merges into a conical surface portion 56 at the free end of the ear. The radius of curvature of the surface portion 54 is just slightly less than the radius of curvature of the inner surface of the collars 34A and 34B, for reasons to be described later. The conical outer surface facilitates the introduction of the ear within the slot, as will be described later. The inner surface of each of the ears 52A and 52B includes a longitudinally extending recess 58 for receipt of a portion of the post 32 therein, as will also be described later.

The central body portion 50 of the insert 30 is hollow and includes a hole 60 therein. The hole is adapted to receive a bolt 62 therethrough. A washer 64 and a nut 66 are disposed on the inner end of the bolt located within the hollow interior of the insert's body 50. The bolt serves as the means for pivotally connecting the first connector member 42 to the insert 30.

In accordance with a preferred embodiment of this invention the first connector member 42 is a conventional cargo tie down hook, such as sold by U.S. Forgecraft, Inc. of Fort Smith, Ak., under the part designation MS27760 FC92. Thus, the member 42 basically comprises a generally triangular plate having a hole 68 (FIG. 3) in one corner. It is through this hole that the bolt 64 extends. An elongated slot 70 is provided in the triangular plate extending along the side opposite the hole 68. A generally U-shaped strap protector 72 is located within the slot. The slot 70 in the connector member 42 serves as the means for fixedly securing one end of the strap 44 to it.

The strap 44 comprises a woven, high strength material, e.g., nylon or polyester, which is folded over itself and stitched at 74 to form a pair of single thickness looped ends 76 and 78 and a three layer thickness central portion 80. A pair of short strips 82 of the same material are located and stitched within the looped ends 76 and 78 double the thickness of those loops. The material of the strap forming the looped end 76 extends through the slot 70 in the connector member to fixedly secure the connector member to the strap. The U-shaped strap protector 72 prevents wearing or erosion of the strap material from the otherwise somewhat sharp edge of the slot 70.

The second connector 48 preferably comprises a conventional D-ring, formed of any suitable material, and has an enlarged opening or hole 84 for connection to a carabiner (not shown) or other connector at the end of the lanyard 28. An elongated slot 86 is provided to fixedly secure the D-ring 48 to the opposite end of the strap from the connector 42. To that end the double thickness loop 78 of the strap extends through the slot 86 in the D-ring.

In order to protect the strap from wear in the event that it should rub against the scaffolding or something located on the scaffolding, the strap 44 includes the heretofore identified reinforcing pad 46. The reinforcing pad is formed of a plastic or other material, such as nylon, polyethylene, etc., of multiple thicknesses and is secured by stitches 88 onto the inner surface of the strap at the middle portion 80 so that it will engages the scaffolding or other structure to which the connector assembly 20 is secured. Thus, the pad has the effect of spreading out the pressure applied to the strap, while also preventing erosion or abrasion of the strap during use. The pad may be bound at each of its edges by a conventional binding material 90 secured by stitches 92, if desired.

The connection of each of the plural connector assemblies 20 to the scaffolding 22 at various positions or anchor points on the scaffolding is accomplished as follows: The collars 34A and 34B for the associated connector assembly 20 are slid along the scaffolding section, be it a post or a rail, until they are at the desired position are spaced from each other by a distance greater than the distance separating the free ends of the ears 52A and 52B of the connector insert 30. The insert 30 is then placed against the scaffolding section so that the recesses 58 in the ears receive a portion of the scaffolding therein. The collars are then slid towards each other, whereupon the ears enter into the slots 36 between the collars 34A and 34B and the post 32. The tapered surfaces 56 facilitate the entry of the ears into the slots. Once the ears are within the slots the set screws 38 are tightened, the cylindrical outer surface portions 54 of the ears will engage the inner surface of the collars 34A and 34B, respectively, thereby securing the connector insert 30 to the post 32 so that it cannot slide therealong.

With the plural connector assemblies in place secured to the various anchor points on the scaffolding, such as shown in FIG. 1, the worker 24 can then connects his/her lanyard 28 to the D-ring hole 84 in the closest assembly 20 via the carabiner (not shown) on the lanyard. In accordance with one preferred method of use, the lanyard worn by the worker is a doubled headed lanyard, such as that disclosed in copending U.S. patent application Ser. No. 07/816,990, filed on Jan. 3, 1992, entitled Dual Connection Lanyard For Use In A Safety System, whose disclosure is incorporated by reference herein. That lanyard is a generally Y-shaped member having a common leg 28A which is arranged to be attached to a safety belt or harness, and a pair of legs 28B and 28C connected to the common leg 28A. Each of the legs of the pair of legs has a carabiner or some clip or fastener at the end thereof for securement to a fixed anchor point. When used with the subject invention either of the legs 28B or 28C of the lanyard 28 are arranged to be releasably secured to any of the connectors 20 forming the various anchor points on the scaffolding. In particular, when using the aforementioned lanyard one of its legs, e.g., 28B in FIG. 1, is connected by its carabiner to a connector assembly 20 adjacent the location at which the worker will be working, leaving the other leg 28C of the lanyard free. Once this connection has been accomplished the worker is protected from falling. When the worker desires to move to another location, e.g., a adjacent position, while being protected from a fall during the move, all that is required is for the worker to connect the carabiner on the free end of the leg of 28C of his/her lanyard to the connector assembly 20 at the desired adjacent position. Once this has been accomplished the worker can then disconnect the leg 28B of his/her lanyard from the connector assembly to which it had been connected.

As should be appreciated by those skilled in the art use the connector assemblies of this invention provide fall protection to workers without having to unnecessarily shortening the lanyard length, thereby giving the worker maximum freedom of movement. Moreover, the pivotable connection between the connector member 42 and the connector insert 30 ensures that freedom of movement isn't compromised. Further, since there are plural connector assemblies located at closely spaced anchoring points all over the scaffolding connection to the scaffolding is made at approximately shoulder the worker is protected from a fall irrespective of where he/she is located, and even if the worker does fall off of the scaffolding he/she will not drop far and thus, should not sustain any injury causing shock.

Without further elaboration the foregoing will so fully illustrate our invention that others may, by applying current or future knowledge, adapt the same for use under various conditions of service.

We claim:

1. A connector assembly for releasable securement to a portion of scaffolding on which a worker wearing a safety restraint will be disposed, said portion of said scaffolding comprising a cylindrical section having a pair of collars disposed thereon, each of said collars defining a channel between it and said section, wherein each of said collars are releasably securable along said portion of said scaffolding, said connector assembly comprising insert means, a first connector member, strap means, reinforcing means, and a second connector member, said insert means having a pair of projections, each of which is releasably located within a respective one of said channels associated with said pair of collars to quickly and releasably secure said connector assembly in place with respect to said scaffolding and to facilitate the replacement of said connector assembly without having to dismantle said scaffolding or remove said collars from said scaffolding, said first connector member having a slot therein, said second connector member having a slot therein and a hole for releasably securing said safety restraint member thereto, said strap means comprising an elongated flexible member having a top and bottom surface and pair of ends, each end being in the form of a loop, said first connector member being pivotally and releasably connected to said insert means, wherein the releasable connection of said first connector member to said insert means facilitates the separation of said insert means from said connector assembly to permit the replacement of various components of said connector assembly, one of said loops of said strap means extending through said slot in said first connector to fixedly secure said first connector to said strap means, the other one of said loops of said strap means extending through said slot in said second connector to fixedly secure said second connector to said strap means, said reinforcing means comprising a pad of a wear resistant material secured to one of said top or bottom surfaces.

2. The connector assembly of claim 1 wherein said first connector member includes a wear resisting member located within said slot to prevent the loop extending through said slot from being eroded.

3. The connector assembly of claim 2 wherein said insert means includes a hole therein and wherein said first connector includes a hole therein, and wherein said connector assembly additionally comprises a threaded fastener extending through said hole in said insert means and said hole in said first connector member to pivotally secure said first connector member to said insert means.

4. The connector assembly of claim 1 wherein said second connector comprises a D-ring.

5. The connector assembly of claim 1 wherein said reinforcing pad is of greater width than the width of said strap means.

6. The connector assembly of claim 5 wherein said reinforcing pad is sewn onto said strap means.

7. The connector assembly of claim 1 wherein said strap means is formed of a fabric material.

8. The connector assembly of claim 7 wherein said fabric material is nylon or polyester.

9. The connector assembly of claim 8 wherein said pad is formed of a fabric material.

10. The connector assembly of claim 9 wherein said fabric material is nylon or polyester.

* * * * *